US005106652A

United States Patent [19]

Sakamoto et al.

[11] Patent Number: 5,106,652

[45] Date of Patent: Apr. 21, 1992

[54] METHOD FOR MANUFACTURING EDGE EMISSION TYPE ELECTROLUMINESCENT DEVICE ARRAYS

[75] Inventors: Koichiro Sakamoto; Minoru Ogawa, both of Shizuoka, Japan

[73] Assignee: Tokyo Electric Co., Ltd., Tokyo, Japan

[21] Appl. No.: 509,787

[22] Filed: Apr. 17, 1990

[30] Foreign Application Priority Data

Apr. 17, 1989 [JP] Japan ..... 1-97083

[51] Int. Cl.[5] ..... B05D 5/12

[52] U.S. Cl. ..... 427/66; 156/656; 156/657; 427/108; 427/109; 427/123; 427/271; 427/284; 427/287

[58] Field of Search ..... 427/66, 108, 109, 123, 427/271, 284, 287; 156/656, 657

[56] References Cited

U.S. PATENT DOCUMENTS 4,149,885 4/1979 Luo et al. ..... 427/66
4,535,341 8/1985 Kun et al. ..... 346/107 R
4,552,782 11/1985 Cattell et al. ..... 427/66
4,775,549 10/1988 Ota et al. ..... 427/66
4,880,475 11/1989 Lindmayer ..... 427/66

*Primary Examiner*—Janyce Bell
*Attorney, Agent, or Firm*—Oblon, Spivak, McClelland, Maier & Neustadt

[57] ABSTRACT

A method for manufacturing edge emission type EL device arrays is disclosed. The method initially involves depositing a first and a second lower electrode layer of different properties. The second lower electrode layer is patterned into a common electrode arrangement conductive to a plurality of edge emission type EL devices. On top of the first and second lower electrode layers, an EL device layer and an upper electrode layer are deposited. The first lower electrode layer is patterned together with the EL device layer and upper electrode layer into a plurality of edge emission type EL devices. The parts ranging from the top edge of the light-emitting edges for the EL devices to the inside of the substrate are etched. This provides a highly smooth light-emitting edge for each EL device.

20 Claims, 10 Drawing Sheets

METHOD FOR MANUFACTURING EDGE EMISSION TYPE ELECTROLUMINESCENT DEVICE ARRAYS

FIELD OF THE INVENTION AND RELATED ART STATEMENT

The present invention relates to a method for manufacturing arrays of edge emission type EL devices positioned side by side on a substrate by use of thin film technology.

In recent years, improvements in electrophotographic printers have been paralleled by the development of diverse light-emitting devices. One of such devices is the electroluminescent (EL) device which, despite its various benefits, has been known for its often insufficient levels of luminous intensity. The disadvantage is now overcome by the development of the so-called edge emission type EL device that has turned out to be about 100 times as intense in emission as conventional EL devices. The edge emission type EL device has an optical waveguide constituted by wrapping a thin film active layer with dielectric layers. A flatly polarized beam of light is emitted from an edge of the active layer. The luminance of the device is high enough to justify growing expectations for its possible use in various applications including the printer head.

An array of edge emission type EL devices whose construction was outlined above will now be described by referring to FIGS. 14 and 15. The construction of a prior art edge emission type EL device 2 is the first to be described in reference to FIG. 15. The EL device 2 has a thin film active layer 3 that contains zinc sulfide and some active elements sandwiched from above and below with dielectric layers 4 and 5, respectively. The layers 4 and 5 are in turn covered from above and below with flat electrodes 6 and 7, respectively. A lower electrode layer, not shown, is deposited on a substrate 8 by thin film technology or other suitable methods. The low electrode layer is patterned by dry etching or like methods into a lower electrode 9 which is a common electrode arrangement conductive to a plurality of edge emission type EL devices 2. Over the lower electrode 9, the layers 3 through 5 and upper electrodes 10 are patterned by dry etching, and then divided. This forms a plurality of edge emission type EL devices 2.

In the construction described above, the lower electrode 9 and the upper electrodes 10 may be wired in a matrix pattern to a driving circuit, not shown. One application of this arrangement is in the line head of an electrophotographic printer; the arrangement may allow the edge emission type EL devices 2 to emit light selectively to form desired images.

The edge emission type EL device array 1 as applied above has numerous edge emission type EL devices 2 formed contiguously on the substrate 8 using thin film technology or similar methods. In the forming process, the layers 3 through 5 and 10 deposited over the substrate 8 of the EL device array 1 are patterned by dry etching or like methods. Because the lower electrode 9 differs in shape from the layers 3 through 5 and 10, the electrode is patterned before these layers are deposited thereon; the layers are then patterned into edge emission type EL devices 2. One crucial requirement for this process is to pattern the layers 3 through 5 and 10 without destroying the lower electrode 9. This is a production stage that is very difficult to accomplish successfully. This difficulty has been a major impediment to improving the productivity of edge emission type EL device arrays 1.

One way to produce uniformly smooth light-emitting edges 11 for a plurality of edge emission type EL devices 2 is to form a notch 12 on the bottom of the substrate over which the EL device array 1 is provided, break off the entire array, and provide a protective layer 13 thereon by sputtering or other techniques, as illustrated in FIGS. 16 (*a*) through 16 (*c*). This method fails to leave the light-emitting edge 11 sufficiently smooth for each finished EL device 2, as depicted in FIG. 17. The rugged edges tend to emit only diffused light, as depicted in FIG. 18, making it impossible to obtain a high-performance edge emission type EL device array 1.

The edge emission type EL device 2 is vulnerable to moisture-induced deterioration. To minimize adverse effects from changes in ambient conditions, the whole edge emission type EL device array 1 is covered with the protective layer 13. But the ruggedness of the light-emitting edges 11 of the EL devices 2 is liable to defeat the effectiveness of the protective layer 13. This has been an impediment to making the edge emission type EL device array 1 stable in performance.

One solution to this problem is to polish the front edge, not shown, of the edge emission type EL device array 1 manufactured in the manner described above until each light-emitting edge 11 thereof becomes sufficiently smooth. Given the fact that the EL device 2 is about 1 $\mu$m thick, polishing the front edge thereof to sufficient smoothness involves unacceptably rigorous manufacturing conditions which cannot be practically met.

OBJECT AND SUMMARY OF THE INVENTION

It is therefore an object of the present invention to provide a manufacturing method for easily producing common electrodes of edge emission type EL devices.

It is another object of the present invention to provide a manufacturing method for acquiring smooth light-emitting edges for edge emission type EL devices.

According to one aspect of the present invention, a first and a second lower electrode layer, different in material property, are deposited on a substrate. The second lower electrode layer is patterned into a common electrode arrangement conductive to a plurality of edge emission type EL devices. On top of the first and second electrode layers, an EL device layer and an upper electrode layer are deposited. The EL device layer, the upper electrode layer and the first lower electrode layer are all patterned together into a plurality of edge emission type EL devices.

The process described above leaves the first lower electrode layer protected by the second lower electrode layer. This protects the electrodes conductive to a plurality of edge emission type EL devices from getting disconnected while the EL device layer is being patterned.

According to another aspect of the present invention, the formation of a thin first lower electrode layer under a thick second lower electrode layer provides better protection to the first lower electrode layer.

According to a further aspect of the present invention, the whole section from the top edge of each light-emitting edge of the numerous edge emission type EL devices to the inside of the substrate therefor is etched, followed by formation of a transparent protective layer between the EL devices and the substrate. The etching makes it easy to provide an edge emission type EL device array with highly smooth light-emitting edges. The transparent protective layer between the edge emission type EL devices and the substrate thereof has no adverse effects on the light-emitting performance of the devices.

According to yet another aspect of the present invention, the surface of the first transparent protective layer between the numerous edge emission type EL devices and the substrate thereof is cleaned, followed by formation of a second transparent protective layer on top of the first. This process provides a protective layer structure that is highly protective with no interlayer defects.

According to another aspect of the present invention, the protective layer structure is formed by the CVD (chemical vapor deposition) method. This makes it easy to form the protective films over the edge emission type EL devices that are three dimensional in construction.

BRIEF DESCRIPTION OF THE DRAWINGS

FIG. 11 (*b*) is a longitudinal sectional view of the comparative EL device array specimen;

Figure 1A:
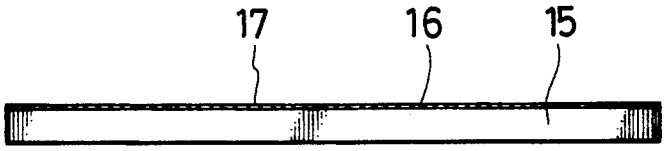
FIGS. 1 (*a*) through 1 (*d*) are views of an edge emission type EL device array being manufactured by use of a first preferred embodiment of the present invention.
Figure 1B:
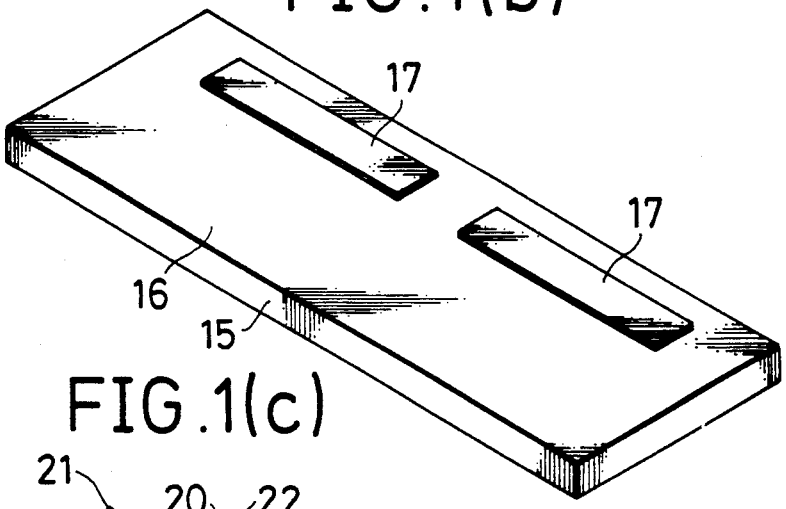
Figure 1C:
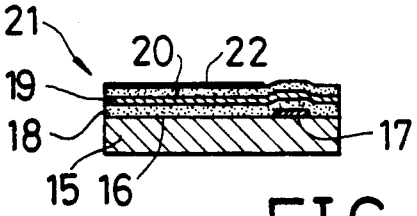
Figure 1D:
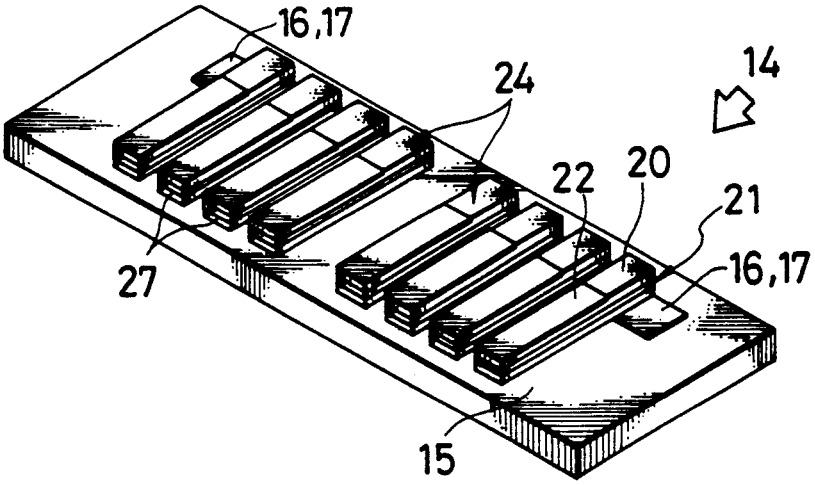

DETAILED DESCRIPTION OF PREFERRED EMBODIMENTS:

A first preferred embodiment of the present invention will now be described by referring to FIGS. 1 through 10. FIGS. 1 (*a*) through 1 (*d*) illustrate how an edge emission type EL device array 14 is manufactured by the method embodying the present invention. As shown in FIG. 1 (*a*), a glass substrate 15 is stacked with a first lower electrode layer 16 and a second lower electrode layer 17, the layer 16 being made of Cr and 500 Å thick and the layer 17 constituted by Ti and 5,000 Å thick.

The lower electrode layer 17 alone is then etched into a common electrode arrangement which is conductive to a plurality of edge emission type EL devices and which is long in the device array direction, as depicted in FIG. 1 (*b*). At this point, the selective etching is performed easily because the first and second lower electrode layers 16 and 17 are different in material property.

After the etching, a dielectric layer 18, an active layer 19 and another dielectric layer 20 are deposited, by use of electron beam evaporation or like methods, to form an EL device layer 21 onto the first and second electrode layers 16 and 17, as shown in FIG. 1 (*c*). The dielectric layer 18 is 3,000 Å thick and made up of $Y_2O_3$; the active layer 19 is 10,000 Å thick, doped with 1% Mn, and comprised of ZnS; and the dielectric layer 20 is 3,000 Å thick and contains $Y_2O_3$.

A Cr film that is 1,000 Å thick is then formed by sputtering over the EL device layer 21. After the Cr film formation, those portions of the film which correspond to the second lower electrode layer 17 are removed by photo-etching to form an upper electrode layer 22. As illustrated in FIG. 1 (*d*), an ion milling machine is then used to etch consecutively the layers 18 through 22 and the first lower electrode layer 16 in order to produce a plurality of edge emission type EL devices 24.

Figure 4:
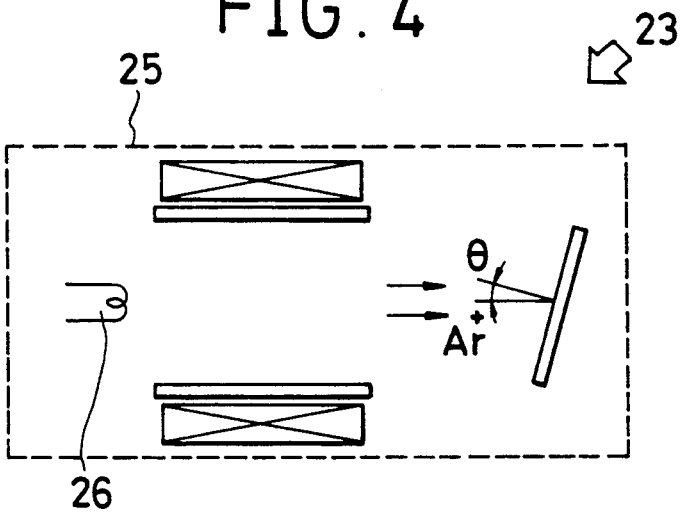
FIG. 4 is a view illustrating how an ion milling machine works in connection with the embodiment.

In the case above, the ion milling machine 23 performs etching physically by applying argon ions onto the target material. In operation, as depicted in FIG. 4, the ion milling machine 23 uses a cathode 26 to discharge electrons that ionize an argon gas, not shown, introduced into a vacuum chamber 25, and guides argon ions onto the target material for physical etching. Unlike dry etching or similar techniques based on reaction gases, the etching operation by this machine etches all deposited films of different properties consecutively. The target material is positioned at an angle to the incident direction of the argon ions so that the etching surface angle may be adjusted.

Figure 5A:
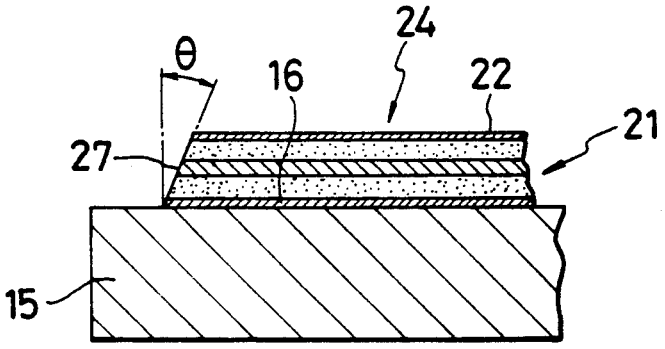
FIGS. 5 (*a*) and 5 (*b*) are longitudinal sectional views of the edge emission type EL device array.
Figure 5B:
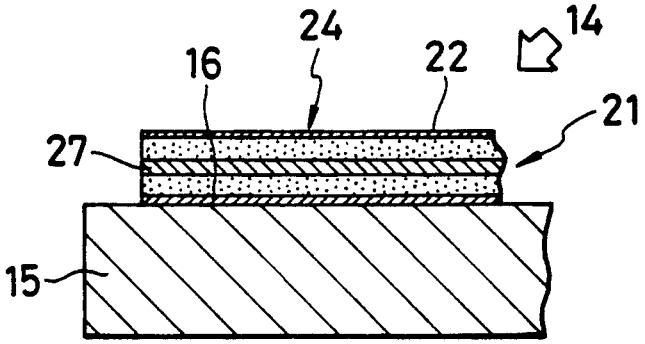

When some edge emission type EL devices 24 were manufactured experimentally with the incident angle $\theta$ of the argon ions set for 30°, the shape of a light-emitting edge 27 of each EL device turned out to be unacceptably inclined relative to the light-emitting direction of the device, as depicted in FIG. 5 (*a*). It was therefore decided to set the argon ion incident angle $\theta$ for 5° for the upper electrode layer 22 through the active layer 19, 10° for the lower dielectric layer 18, and 15° for the first lower electrode 16 in preparation for etching. The result was a smoothly finished light-emitting edge 27 substantially perpendicular to the light-emitting direction, as shown in FIG. 5 (*b*).

Figure 2:
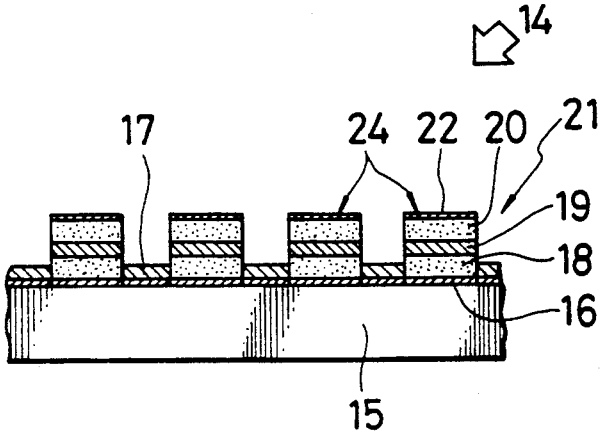
FIG. 2 is a front view of the edge emission type EL device array.

With the edge emission type EL device array 14, the first lower electrode layer 16 is constituted by a very thin Cr film. This film is easily etched together with the edge emission type EL devices 24, leaving no projection on the light-emitting edge 27 thereof. On the other hand, the first lower electrode layer 16 located behind the edge emission type EL devices 24 is protected by the second lower electrode layer 17 made up of a thick Ti film. The layer 16 is thus left uncut during etching by the ion milling machine 23. This provides reliable formation of the second lower electrode layer 17 conductive to a plurality of edge emission type EL devices 24, as illustrated in FIGS. 2 and 3.

Figure 6A:
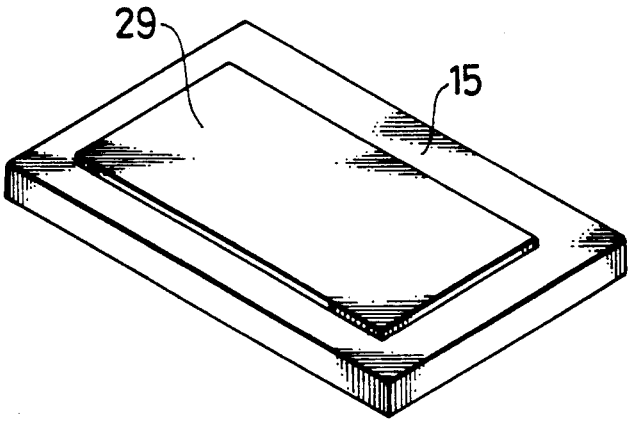
FIGS. 6 (*a*) through 6 (*c*) are views of an edge emission type EL device array specimen being manufactured for comparison purposes.
Figure 6B:
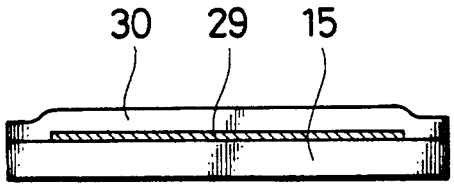
Figure 6C:
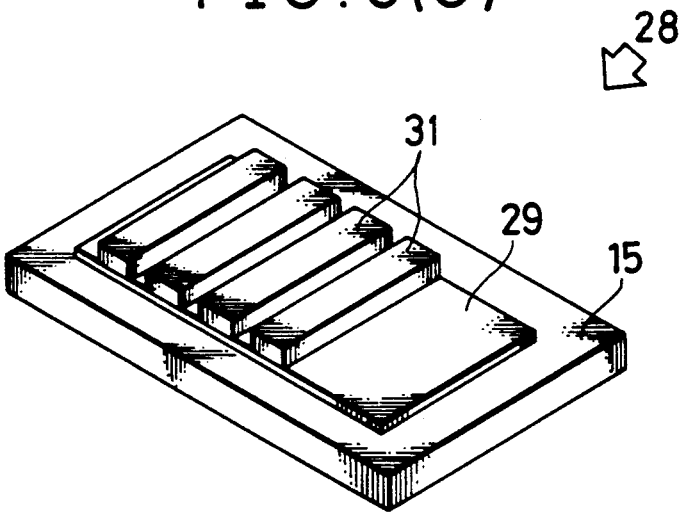
Figure 7:
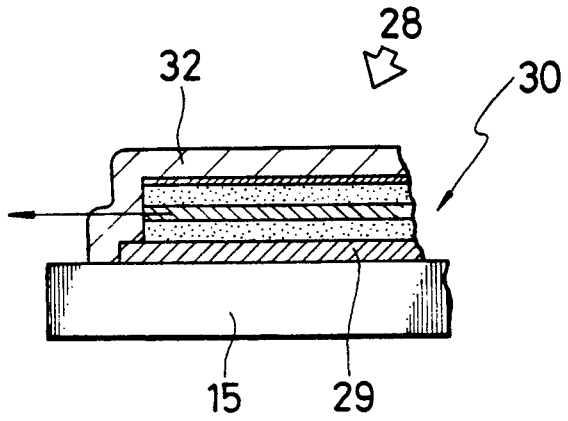
FIGS. 7 and 8 are longitudinal sectional views of the comparative specimen.
Figure 8:
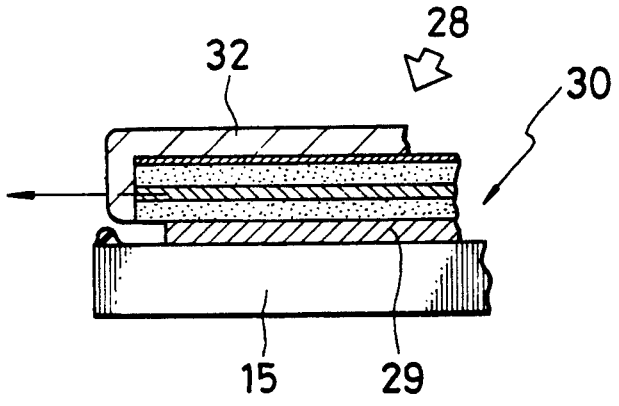
Figure 9:
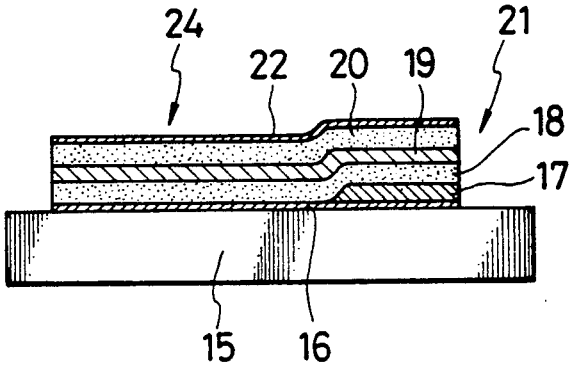
FIG. 9 is a longitudinal sectional view of another specimen.

For comparison with the edge emission type EL device array 14 manufactured by the method embodying the present invention, an edge emission type EL device array 28 having a single lower electrode layer will now be described by referring to FIGS. 6 through 8. FIGS. 6 (*a*) through 6 (*c*) illustrate how the EL device array 28 is manufactured. As shown in FIGS. 6 (*a*) and 6 (*b*), a lower electrode layer 29 made of a thick Cr film and an EL device layer 30 are deposited by sputtering onto the glass substrate 15. Then the EL device layer 30 is etched, as depicted in FIG. 6 (*c*), to produce numerous edge emission type EL devices 31 consecutively, the lower electrode layer 29 being left uncut.

It should be noted that with this edge emission type EL device array 28, the lower electrode layer 29 under each edge emission type EL device 31 is not etched. As shown in FIGS. 7 and 8, the layer 29 thus projects or recedes from the plane of the light-emitting edge for each edge emission type EL device 34 due to such factors as an error in aligning the exposure mask during photo-etching. Where the edge emission type EL device array manufactured in the above-described manner is covered with a protective layer 32 made up of $Si_3N_4$ or other elements, one of two faulty EL device arrays may result. One faulty edge emission type EL device array may have its layer 32 projecting therefrom due to the protruded lower electrode layer 29, as shown in FIG. 7. The projection in turn interferes with the light-emitting edge of each EL device and hampers the light emission therefrom. The other faulty edge emission type EL device array may have its protective layer 32 receding therefrom due to the recessed lower electrode 29, as illustrated in FIG. 8. In either case, the reliability of the above-described EL device array is lowered.

Figure 3:
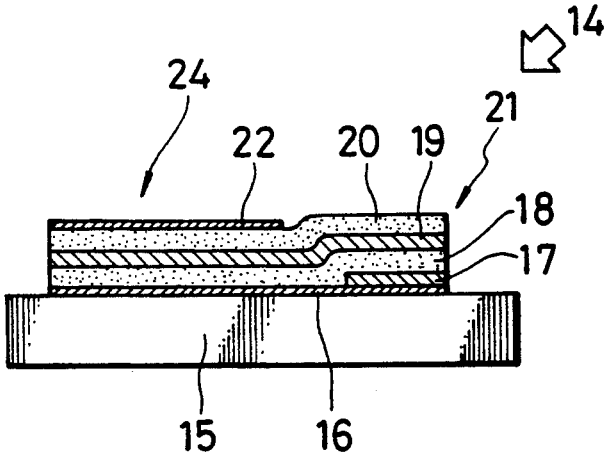
FIG. 3 is a longitudinal sectional view of the edge emission type EL device array.

With the edge emission type EL device array 14 according to the present invention, those portions of the upper electrode layer 22 which face the second lower electrode layer 17 are removed, as shown in FIG. 3. This is intended, during application of a driving voltage between the upper and lower electrode layers 22 and 17, to prevent discharge breakdown at the second lower electrode layer 17 whose front edge is sharply pointed. However, the discharge breakdown may also be prevented by tapering the front edge of the second lower electrode layer 17 through etching or similar techniques. If the latter process is adopted, there is no need to remove those portions of the upper electrode layer 22 which face the second lower electrode layer 17.

Figure 10:
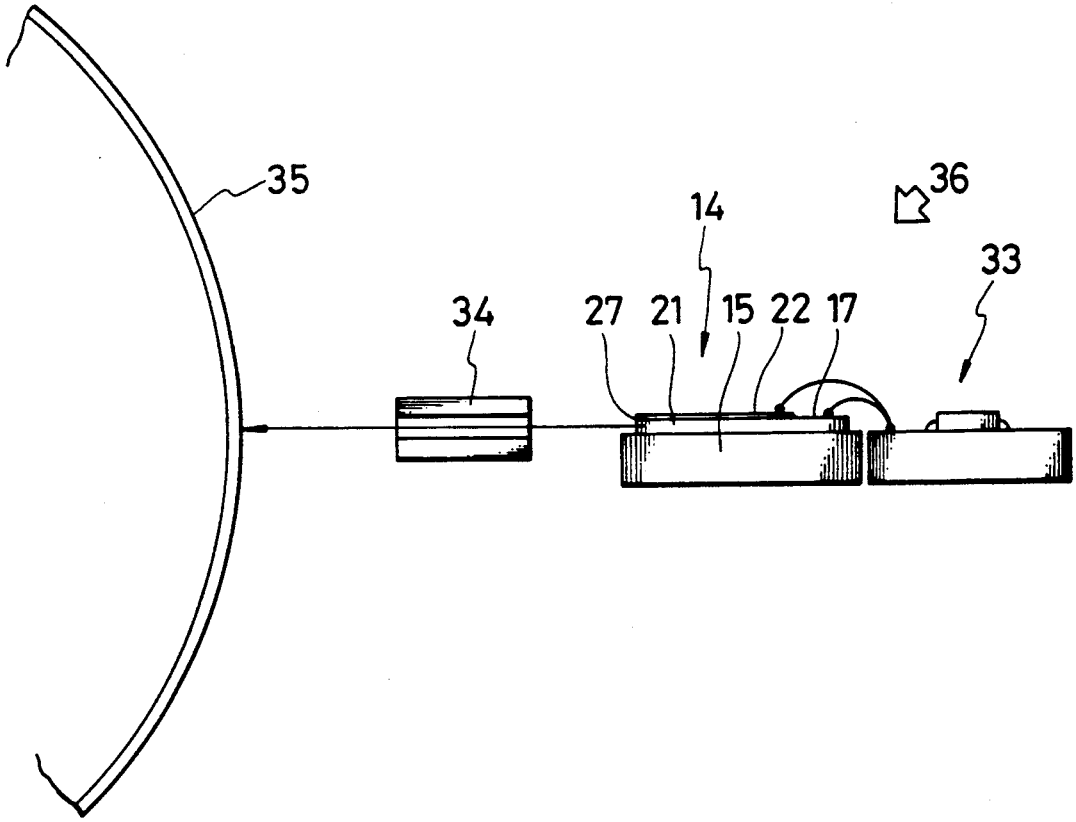
FIG. 10 is a view illustrating how a line printer works using the edge emission type EL device array.

In an application illustrated in FIG. 10, the edge emission type EL device array 14 combined with a driving circuit 33, a rod lens array 34 and others is located adjacent to a photosensitive drum 35. This is an easy way to produce a small, high-performance line printer 36.

A second preferred embodiment of the present invention will now be described by referring to FIGS. 1 through 13. According to this method embodying the invention, an edge emission type EL device array 37 comprises the electrode layers 16, 17 and 22 as well as the EL device layer 21 on the glass substrate 15, as with the above-described EL device array 14. With this type of EL device array 37, the etching operation by the ion milling machine 23 also etches the glass substrate 15, as illustrated in FIG. 12, to produce a recessed portion 38 flush with the light-emitting edge 27 on the glass substrate 15.

Over the edge emission type EL device array 37 obtained as described above, a first protective layer 39 is provided by the CVD (chemical vapor deposition) method, the layer being made up of a silicon nitride (SiNx) film 5,000 Å thick. The surface of the layer 37 is cleaned by air blow. Over the protective layer 37, a second protective layer 40 is formed by the CVD method, the layer being constituted by a silicon nitride (SiNx) film 5,000 Å thick.

Figure 11A:
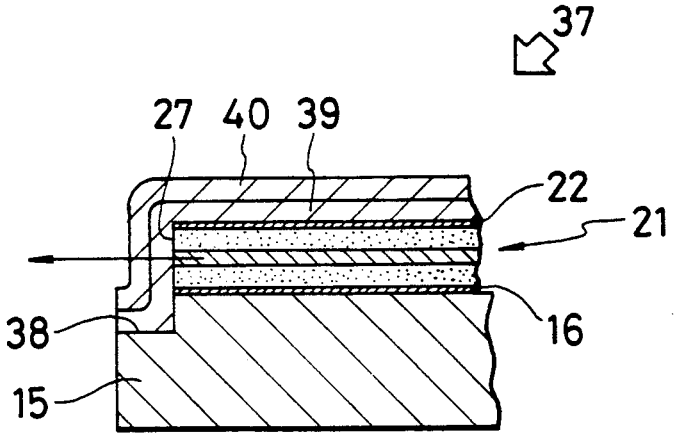
FIG. 11 (*a*) is a longitudinal sectional view of an edge emission type EL device array manufactured by a second preferred embodiment of the present invention.
Figure 11B:
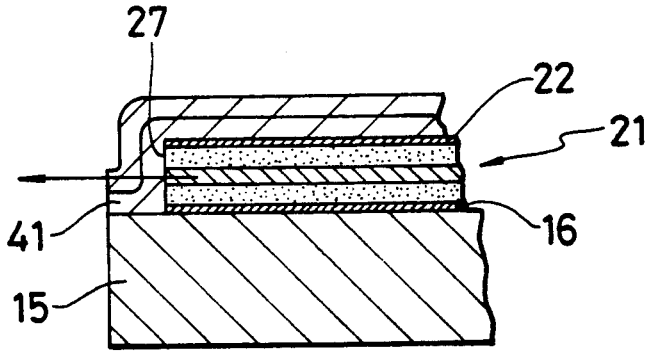
Figure 12:
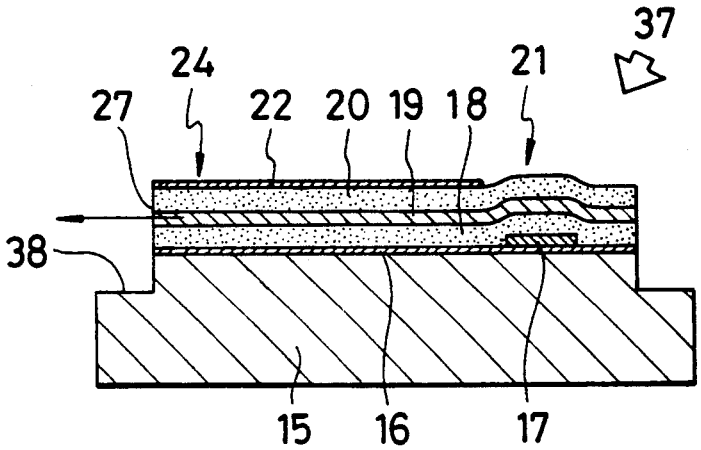
FIG. 12 is another longitudinal sectional view of the edge emission type EL device array manufactured by the second embodiment.

At this point, as depicted in FIG. 11 (*a*), the recessed portion 38 flush with the light-emitting edge 27 has been formed at the top front of the glass substrate 15. Therefore, the first and second protective layers 39 and 40, both made thick and placed on top of these parts, do not interfere with light emission. A case may be assumed in which the prior art edge emission type EL device array 1 is covered with a thick protective layer 41, with no etching performed on the glass substrate 15. In such a case, the glass substrate 15 projects forward immediately below the light-emitting edges 27, as shown in FIG. 11 (*b*). This makes it highly probable for the protective layer 41 to interfere with the optical path of each EL device. By contrast, with the edge emission type EL device array 37 according to the present invention, the optical path thereof is left unimpeded by etching the parts ranging from the top edge of the light-emitting edges 27 to the inside of the glass substrate 15.

The light-emitting edge 27 of each edge emission type EL device 31 and the glass substrate 15 are etched in the same shape on the EL device array 37. This etching leaves no staggers between continued parts. As a result, the first protective layer 39 is formed easily and reliably. Because the second protective layer 40 is deposited on top of the first protective layer 39 after the surface of the latter is cleaned, there is virtually no possibility of having such defects as pin holes during layer formation. Since each edge emission type EL device 31 is sufficiently protected against the external environment, the EL device array 37 is reliable and provides high levels of stable performance.

With the edge emission type EL device array 37 according to the present invention, the first and second protective layers 39 and 40 thereof are produced by the CVD method that is superior to the sputtering or evaporation technique in forming three-dimensional film structures. As a result, both the step coverage of the device array production based on this method and the productivity thereof are high.

Figure 13:
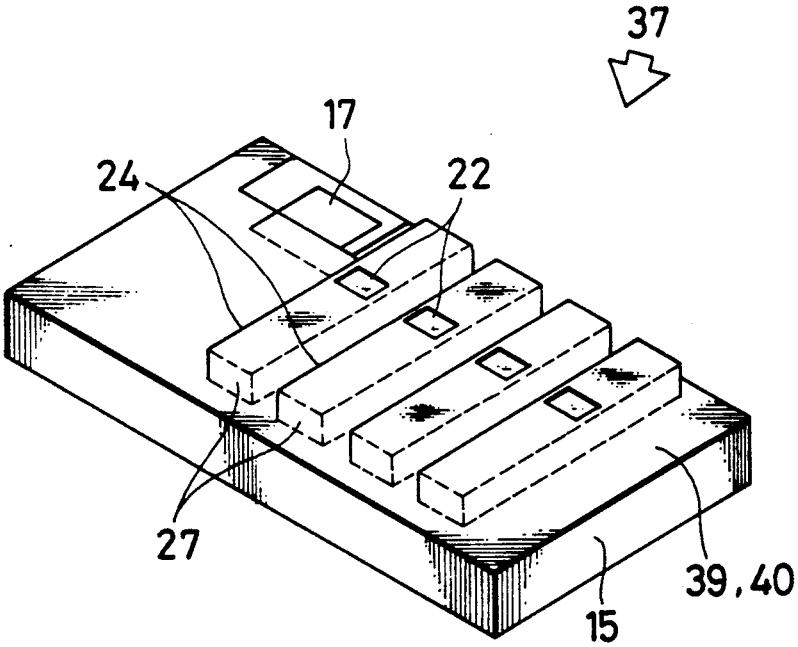
FIG. 13 is a perspective view of the edge emission type EL device array.
Figure 14:
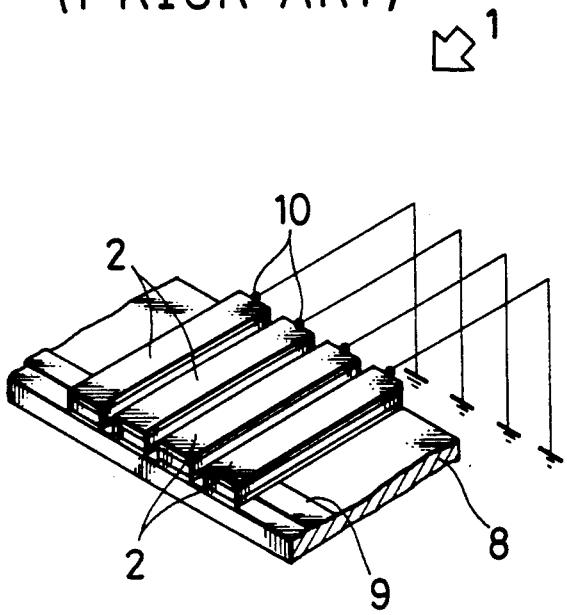
FIG. 14 (PRIOR ART)
FIG. 14 is a perspective view of a prior art edge emission type EL device array.
Figure 15:
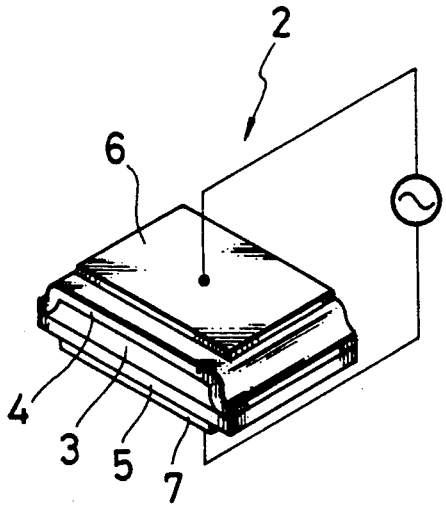
FIG. 15 (PRIOR ART)
FIG. 15 is a perspective view of a prior art edge emission type EL device.
Figure 16A:
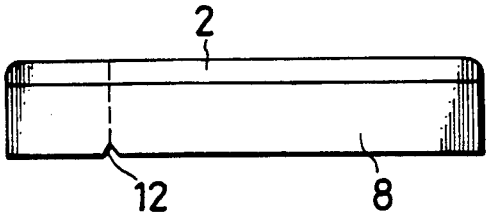
FIGS. 16 (*a*), 16(*b*), 16(*c*) is a set of views illustrating an edge emission type EL device array being manufactured by use of a prior art method.
Figure 16B:
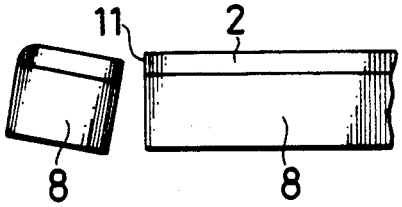
Figure 16C:
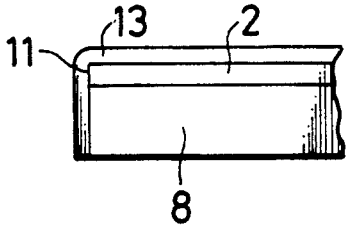
Figure 17:
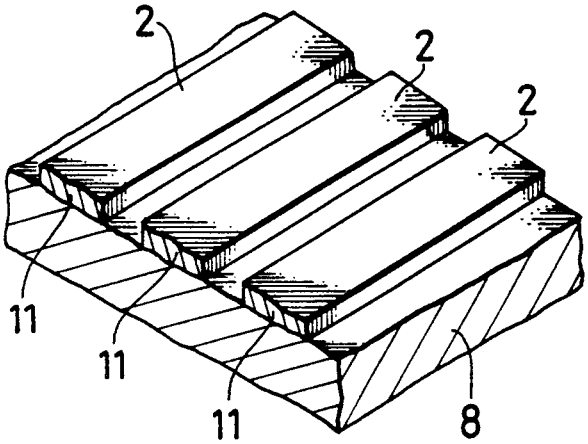
FIG. 17 is a perspective view of the edge emission type EL device manufactured by the prior art method.
Figure 18:
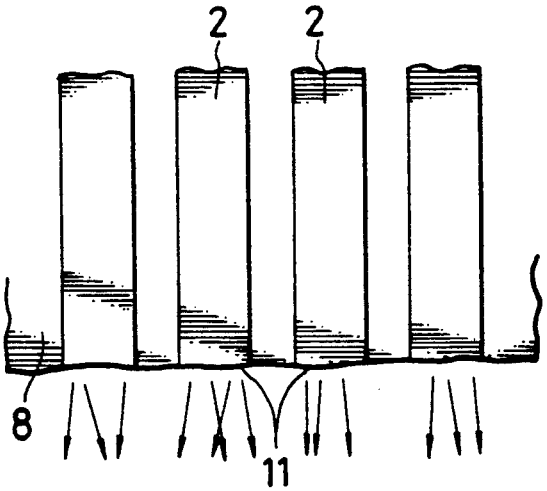
FIG. 18 is a view illustrating how the edge emission type EL device array manufactured by the prior art method emits light.

The edge emission type EL device array 37 formed as described above may have part of its first and second protective layers 49 and 40, on the electrode layers 17 and 22, removed by $CF_4$ gas. This makes it easy to install wiring, as illustrated in FIG. 13. The EL device array wired in this manner may be used in, say, a simplified line printer such as the one shown in FIG. 13.

What is claimed is:

1. A method for manufacturing edge emission type electroluminescent (EL) device arrays, said method comprising the steps of:

depositing a first lower electrode layer on a substrate;

depositing a second lower electrode layer on the first lower electrode layer, the first and lower electrode layers being made of different electrically conductive materials which permit selective etching of the second lower electrode layer without affecting the first lower electrode layer;

patterning, by etching, said second lower electrode into at least one strip to form a common electrode for electrical connection to a plurality of edge emission type EL devices;

depositing an EL device layer, comprising an active layer, made of a material for emitting a polarized beam of light from an edge of the active layer upon application of an electrical current to the EL device layer, sandwiched between first and second dielectric layers, on said first and second lower electrode layers;

depositing an upper electrode layer on the EL device; and patterning, by etching, said first lower electrode layer together with said EL device layer and upper electrode layer into a plurality of said edge emission type EL devices on said substrate.

2. A method for manufacturing edge emission type EL device arrays according to claim 1, wherein said first lower electrode layer is thinner than said second lower electrode layer.

3. A method for manufacturing edge emission type EL device arrays according to claim 1, wherein said first lower electrode layer is constituted by Cr and said second lower electrode layer by Ti.

4. A method for manufacturing edge emission type EL device arrays according to claim 1, wherein those portions of said upper electrode layer which correspond to said second lower electrode layer in terms of thickness are removed.

5. A method for manufacturing edge emission type EL device arrays according to claim 1, wherein a front edge of said second lower electrode layer is tapered.

6. A method for manufacturing edge emission type EL device arrays according to claim 1, said method further comprising the steps of:

etching the parts ranging from the top edge of light-emitting edges of said many edge emission type EL devices consecutively formed on said substrate down to the inside of said substrate; and providing a first transparent protective layer between said edge emission type EL devices and said substrate.

7. A method for manufacturing edge emission type EL device arrays according to claim 6, said method further comprising the steps of:

cleaning the surface of said transparent first protective layer between said many edge emission type EL devices on said substrate and said substrate; and providing a transparent second protective layer on top of said first protective layer.

8. A method for manufacturing edge emission type EL device arrays according to claim 6 or 7, wherein said protective layers are formed by chemical vapor deposition (CVD) method.

9. A method for manufacturing edge emission type EL device arrays according to claim 1, wherein the material of the first lower electrode layer includes Cr.

10. A method for manufacturing edge emission type EL device arrays according to claim 1, wherein the material of the second lower electrode layer includes Ti.

11. A method for manufacturing edge emission type EL device arrays according to claim 1, wherein the material of the active layer includes zinc sulfide.

12. A method for manufacturing edge emission type EL device arrays according to claim 1, wherein the EL device layer is deposited by electron beam evaporation.

13. A method for manufacturing edge emission type EL device arrays according to claim 1, wherein the upper electrode layer is made of Cr.

14. A method for manufacturing edge emission type EL device arrays according to claim 1, wherein the step of patterning, by etching, said first lower electrode layer together with said EL device layer and upper electrode layer comprises:

photoetching said upper electrode layer into a plurality of strips; and etching, by ion milling, said first lower electrode layer and said EL device layer under the plurality of strips formed by etching of said upper electrode layer, to form the plurality of edge emission type EL devices on said substrate.

15. A method for manufacturing edge emission type electroluminescent (EL) device arrays, the method comprising the steps of:

depositing a first lower electrode layer on a substrate;

depositing a second lower electrode layer on the first lower electrode layer, the first and lower electrode layers being made of different electrically conductive materials which permit selective etching of the second lower electrode layer without affecting the first lower electrode layer;

selective etching the second lower electrode into at least one strip to form a common electrode for electrical connection to a plurality of edge emission type EL devices;

depositing an EL device layer, comprising an active layer, made of a material for emitting a polarized beam of light from an edge of the active layer upon application of an electrical current to the EL device layer, sandwiched between first and second dielectric layers, on the first and second lower electrode layers;

depositing an upper electrode layer on the EL device layer;

etching the upper electrode layer into a plurality of strips; and consecutively etching the EL device layer and the first lower electrode layer under the plurality of strips formed by etching of the upper electrode layer, to form a plurality of edge emission type EL devices on the substrate.

16. A method according to claim 15, wherein the step of etching the upper electrode layer is performed by photoetching.

17. A method according to claim 15, wherein the step of consecutively etching the EL device layer and the first lower electrode layer is performed by ion milling.

18. A method according to claim 15, wherein the material of the first lower electrode layer includes Cr.

19. A method according to claim 1, wherein the material of the second lower electrode layer is Ti.

20. A method according to claim 1, wherein the material of the active layer includes zinc sulfide.

* * * * *